US006152343A

United States Patent [19]

Shin

[11] Patent Number: 6,152,343

[45] Date of Patent: Nov. 28, 2000

[54] GOLF BAG CARRYING STRAP

[76] Inventor: Sang Chul Shin, 13037 Lakeland Rd. Unit F, Santa Fe Springs, Calif. 90670

[21] Appl. No.: 09/174,492

[22] Filed: Oct. 15, 1998

[51] Int. Cl.[7] ..... A45F 3/04

[52] U.S. Cl. ..... 224/645; 224/627; 224/264; 224/259; 224/643; D3/255

[58] Field of Search ..... 224/645, 643, 224/266, 259, 627, 261, 263, 264, 260; D3/255

[56] References Cited

U.S. PATENT DOCUMENTS

| | | | |
|---|---|---|---|
| D. 302,073 | 7/1989 | Biggs | 224/260 X |
| D. 348,567 | 7/1994 | Dunn . | |
| D. 362,752 | 10/1995 | Steurer . | |
| D. 387,556 | 12/1997 | Beebe et al. . | |
| D. 411,039 | 6/1999 | Reimers et al. | D3/255 |
| D. 412,396 | 8/1999 | Reimers et al. | D3/255 |
| 2,853,111 | 9/1958 | Williams . | |
| 3,233,803 | 2/1966 | Gray | 224/263 X |
| 4,487,347 | 12/1984 | Zegar . | |
| 4,600,134 | 7/1986 | Colby | 224/260 |
| 4,949,888 | 8/1990 | May | 224/627 X |
| 5,009,349 | 4/1991 | Eide et al. | 224/264 X |
| 5,038,984 | 8/1991 | Izzo . | |
| 5,042,703 | 8/1991 | Izzo . | |
| 5,042,704 | 8/1991 | Izzo . | |
| 5,348,205 | 9/1994 | Steurer . | |
| 5,361,952 | 11/1994 | Gold | 224/643 |
| 5,419,473 | 5/1995 | Lamar . | |
| 5,558,259 | 9/1996 | Izzo . | |
| 5,579,966 | 12/1996 | Krumweide et al. | 224/645 X |
| 5,593,077 | 1/1997 | Izzo . | |
| 5,636,778 | 6/1997 | Jones et al. . | |
| 5,806,733 | 9/1998 | Smith | 224/264 |
| 5,954,254 | 9/1999 | Maeng | 224/645 |
| 5,961,019 | 10/1999 | Gleason et al. | 224/643 |
| 6,006,974 | 12/1999 | Varney et al. | 224/645 |

FOREIGN PATENT DOCUMENTS

| | | | |
|---|---|---|---|
| 190880 | 1/1923 | United Kingdom . | |
| 95/01112 | 1/1995 | WIPO | 224/260 |

*Primary Examiner*—Allan N. Shoap
*Assistant Examiner*—Robin A. Hylton
*Attorney, Agent, or Firm*—Gene Scott-Patent Law & Venture Group

[57] ABSTRACT

A monolithic yolk type collar provides four adjustable straps for two or four point attachment to a golf bag. The collar is adapted to enable transverse mounting of the golf bag on the back of the golfer. The collar has a broad surface with compliant material for comfort and is adapted to take the necessary shape to fit a given golfer.

5 Claims, 3 Drawing Sheets

GOLF BAG CARRYING STRAP

BACKGROUND OF THE INVENTION

1. Field of the Invention

This invention relates generally to golf bag carrying straps, and more particularly to such a carrying strap and the combination of a golf bag and its carrying strap, whereby the carrying strap includes an over-the-shoulder yolk type collar.

2. Description of Related Art

The following art defines the present state of this field:

Steurer, U.S. Pat. No. 362,752 teaches the design for an H-shaped dual strap for a golf bag.

Beebe et al., U.S. Pat. No. 387,556 teaches the design for a golf bag with dual shoulder straps.

Dunn, U.S. Pat. No. 348,567 teaches the design for a golf bag with a single strap.

Izzo, U.S. Pat. No. 5,593,077 provides a shoulder strap assembly for a golf bag, a first shoulder strap extends longitudinally between spaced locations on the outer surface of the bag and a second shoulder strap has opposite connecting ends which are connected in close proximity to one another to the bag adjacent to one of the spaced locations to which the first shoulder strap member is connected and in such a way that the second shoulder strap will extend away from the bag in a generally loop-shaped configuration whereby the bag may be suspended by one or both shoulder straps from one or both shoulders of the golfer or caddy.

Izzo, U.S. Pat. No. 5,558,259 describes a golf bag with a dual carrying strap assembly. In one embodiment, the strap assembly includes a first strap which is attached to the golf bag and interfaces with the golf bag at first and second longitudinally displaced locations. The strap assembly also includes a separate second strap which is also attached to the golf bag and which one end thereof interfaces with the golf bag at the second location and which its other end either interfaces with the golf bag at this same second location or at an intermediate location such as at the carrying handle of the golf bag. Nonetheless, the two separate straps form two loops such that the golf bag may be supported on both of the golfer's shoulders.

Izzo, U.S. Pat. No. 5,042,703 describes a dual shoulder strap assembly for a golf bag having first and second strap members connected in end-to-end relation to one another along one side of the golf bag, a handle grip interconnecting adjoining ends of the strap members, and circumferential loops serve to connect opposite extreme ends of the first and second strap members to the golf bag in such a way as to maintain the bag in centered relation against the back of the carrier when the straps are passed over the shoulders. The upper and lower extreme ends of the strap members are self-adjusting circumferentially, and the adjoining ends between the strap members are interconnected in such a way as to maintain the strap members in an elevated position so that the bag can be easily lifted off the ground and more easily placed on the shoulders of the carrier.

Izzo, U.S. Pat. No. 5,038,984 provides a golf bad has a support strap assembly that allows carriage by a person. The strap assembly includes a first strap having one strap end secured to the golf bag at a first location at its upper, open end, and the other strap end is secured to the golf bag at a second location longitudinally spaced from the first location. A second strap has one end secured to the golf bag at the second location, and the other strap end is secured to the golf bag at a third location longitudinally spaced from the second location between the second location and the closed end of the golf bag. The ends secured at the second location are preferably attached to one another to form a central portion for the strap assembly. The two straps thus allow the golf bag to be carried on both shoulders and oriented transversely across the back. Various mounts are described for these two straps, and different adjustment and padding structures are disclosed.

Izzo, U.S. Pat. No. 5,042,704 describes a golf bag carrying system, in the form of a dual strap carrier, including a first and second strap secured to the golf bag to define arm and shoulder openings. The straps have shoulder pads and one of which may be covered with a relatively slick material. The first strap second end and the second strap first end are attached to a mid-portion of the bag at a central location. The other ends of the first and second straps are secured to the golf bag longitudinally on opposite sides of the central location. The straps include a first and second resilient strap elements at the central location, and the resilient elements terminate at a location spaced from the shoulder pads. These resilient strap elements position thus the straps for easy access. The first, second and third mounts for securing the straps to the bag are selectively adjustable longitudinally along the bag to balance the bag and to adjust for shoulder width. Also, the pads may be laterally arcuate to facilitate wear. Furthermore, a concavity shaped structure may be formed in the bag to conform to the golfer's back.

Jones, et al., U.S. Pat. No. 5,636,778 describes a double strap system for golf bags including a first shoulder strap having upper and lower ends attached to a generally tubular body of a golf bag at first and second locations, respectively. In one embodiment of the double strap system, the lower end of the first shoulder strap is connected to a buckle and slide mechanism which is provided for relocating the second location in a direction that is generally parallel to a length dimension of the golf bag body. A second shoulder strap has opposite ends attached to the golf bag body at third and fourth locations that are spaced apart in another direction. In an alternative embodiment of the double strap system, the lower end of the first shoulder strap may be connected to either one of a pair of attachment devices mounted on the golf bag body to thereby relocate the second location.

Steurer, U.S. Pat. No. 5,348,205 describes a golf bag in the form of a tubular receptacle with a handle thereon having a dual-loop two-point shoulder strap for engaging both shoulders of an individual carrying the golf bag. The shoulder strap, in one embodiment has a single elongated belt with mutually opposed belt ends. One belt end and a first portion of the belt between the belt ends is connected to a first point on a golf bad and defines a first loop through which an individual inserts one arm to support the golf bag at least partially on one shoulder. The other belt end and a second portion of the belt between the belt ends is connected to a second point on the golf bag and defines a second loop through which an individual inserts another arm to support the golf bag at least partially on another shoulder Zegar, U.S. Pat. No. 4,487,347 comprises a golf bag and a carrying device. It includes an elongated rigid bar which is attachable to a conventional single strap golf bag. The bar includes perforations. In one embodiment, the two shoulder straps are designed to be adjustable and include provision for quick attachment to and detachment from the elongated rigid bar.

Lamar, U.S. Pat. No. 5,419,473 describes a golf bag to be carried by a user for retaining golf clubs having an elongated tubular container, a shoulder strap system for carrying the container on the user's shoulder and a waist band system for fastening the container to the user's waist to support the weight of the container with the user's lower body. The waist band system including a waist band for fastening around the user's waist and a lumbar pad for providing cushioning to the user's lower back. The golf bag allows the user to transfer the weight of the bag from the shoulders to the lower back to ameliorate fatigue and soreness to the shoulders and to improve the golfer's posture and golf ability.

Williams, U.S. Pat. No. 2,853,111 teaches a golf bag with a pair of circumferential, spaced apart straps for carrying the bag across the back. The straps are fully separated and independent.

Dunn teaches a single longitudinally oriented shoulder strap. Zegar and Williams each teach the use of separate and independent shoulder straps extending circumferentially from the side of a golf bag. Izzo teaches a single strap configured into a double shoulder loop assembly with three point connection to the golf bag. Lamar, Jones et al, Steurer '205 and Beebe et al each teaches dual independent shoulder straps arranged in various ways on the golf bag. Steurer '752 teaches a harness having two separate halves interconnected by a joining strap and a four point connection to the golf bag. However, the prior art does not teach a monolithic harness type collar arranged with optional four or two point connection to the golf bag. The present invention teaches this very convenient type of strap and provides related advantages as described in the following summary.

SUMMARY OF THE INVENTION

The present invention teaches certain benefits in construction and use which give rise to the objectives described below.

The present invention provides a monolithic yolk type collar with four adjustable straps for two or four point attachment to a golf bag. The collar is adapted to enable transverse mounting of the golf bag on the back of the golfer. The collar has a broad surface and is made with compliant material in order to spread out the weight carried for comfort and the material of which the collar is made is adapted to take the necessary shape to fit a given golfer. The collar is stiff enough to provide action as a single unit when being handled and has the advantage thereby of avoiding the tangling of the various straps attached to it as well as other advantages such as being able to be more easily attached and detached to the person wearing the unit.

A primary objective of the present invention is to provide a golf bag carrying strap having advantages not taught by the prior art.

Another objective is to provide such a carrying strap that is easily mounted onto a wide variety of golf bags in either a two or a four point attachment.

A further objective is to provide such a carrying strap that is easily adjusted to fit a wide range of individuals.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figures 1, 2:
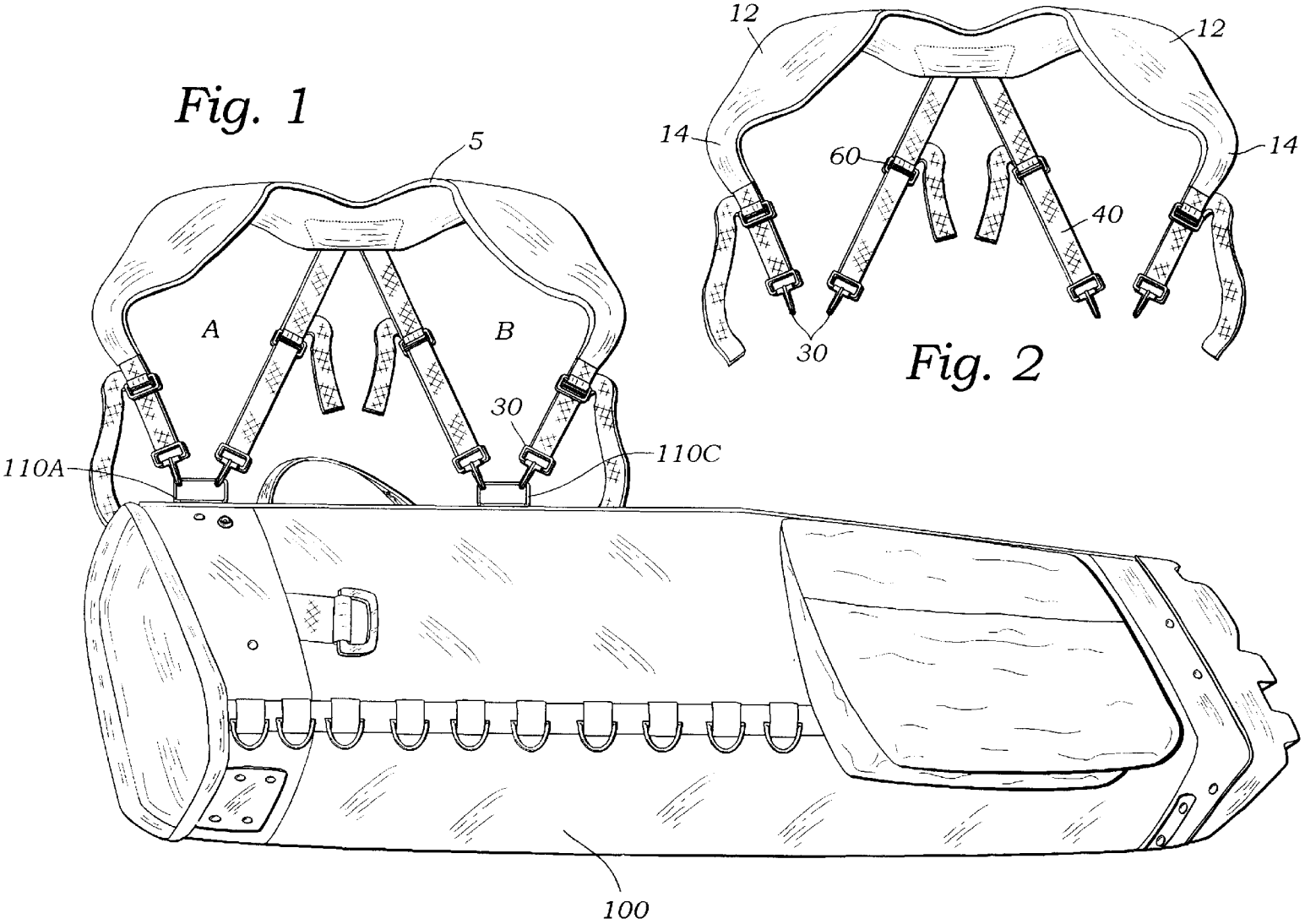
FIG. 1 is a perspective view of a front side of the preferred embodiment of the present invention showing a four point mounting of the carrying strap of the invention to the golf bag.
FIG. 2 is a perspective view of a front side of the preferred embodiment of the present invention showing a two point mounting of the carrying strap thereof.
Figure 3:
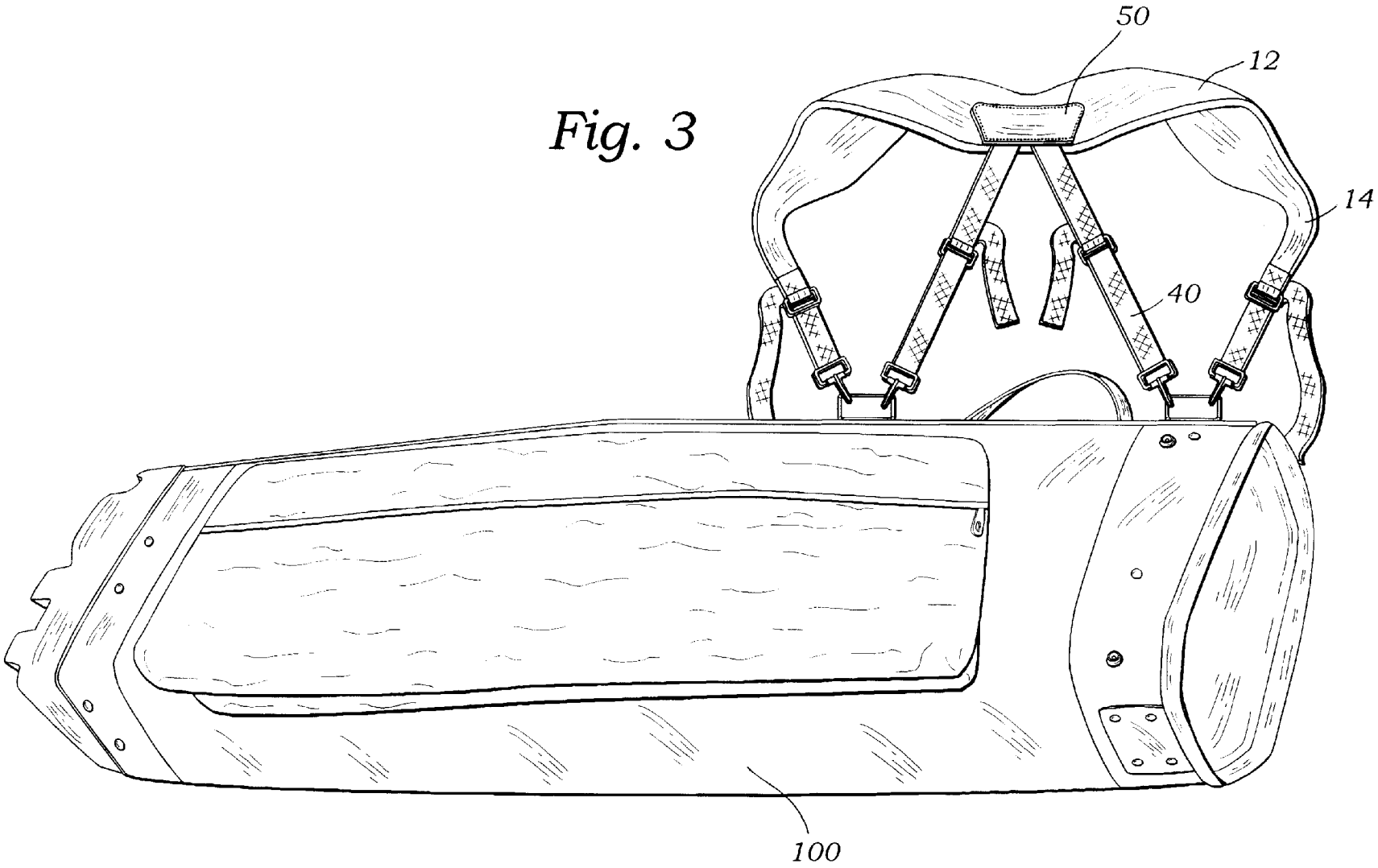
FIG. 3 is a perspective view of the carrying strap thereof.

The above described drawing figures illustrate the invention, a golf bag carrying strap apparatus 5 comprising a unitary C-shaped yolk collar 10 having a shoulder portion 12 adapted for extending around the neck and over the shoulders of a person, and a pair of integral upper chest portions 14 extending downwardly therefrom over the upper chest of the person; a pair of front straps 20, one of the front straps engaged with and extending from a terminal end 16 of each of the upper chest portions 14 of the yolk collar 10, the front straps 20 each terminating with a clip means 30 which may be a spring clip or any other type of clip of well known construction; a pair of rear straps 40, each of the rear straps being joined at a common point 50 at a rearmost position 52 of the shoulder portion 12 of the yolk collar 10, a free end 42 of each of the rear straps 40 terminating with one said clip means 30. Preferably, the front straps 20 and the rear straps 40 each provide a length adjustment means 60. Preferably, the yolk collar 10 comprises an interior layer 17 of at least ½ inch thick foam rubber and an outer layer 18 of a wear resistant fabric tightly encompassing the interior layer 17, and preferably the foam rubber is of such resilience and conformability as to take a semi-permanent curvature through use. The yolk collar 10 is preferably of such stiffness as to move as a single body, thus providing a convenience in handling as well as in placing the yolk collar 10 onto the shoulders and in removing same therefrom.

Another embodiment of the invention provides for a combination golf bag and golf bag carrying strap apparatus, the carrying strap 5 being configured as defined above, the combination comprising a golf bag 100 providing a plurality of strap attachment rings 110, wherein a first two of the attachment rings 100A and 100B are positioned in mutually spaced apart relationship adjacent to an open end 120 of the golf bag 100, said open end for receiving golf clubs (not shown) into the golf bag 100, and further wherein a second two of the attachment rings 110C and 110D are positioned respectively in longitudinal alignment with the first two of the attachment rings 110A and 110B in mutually spaced apart medial positions on the golf bag 100. The golf bag carrying strap 5 comprises the unitary C-shaped yolk collar 10 having the shoulder portion 12 adapted for extending around the neck and over the shoulders of a person, and the pair of integral chest portions 14 extending downwardly therefrom over the upper chest of the person, as well as the pair of front straps 20, one of the front straps engaged with and extending from the terminal end 16 of each of the chest portions 14 of the yolk collar 10, one of the front straps 20 terminating with the clip means 30 engaged with one of the first two of the attachment rings 110B, and the other one of the front straps 20 terminating with the clip means 30 engaged with one of the second two of the attachment rings 110D and finally, as described above, the pair of rear straps 40, each of the rear straps being joined at the common point 50 at the rearmost position 52 of the shoulder portion 12 of the yolk collar 10, the free end 42 of one of the rear straps

40 terminating with the clip means 30 engaged with the other one 110A of the first two of the attachment rings 110, and the free end 42 of the other of the rear straps 40 terminating with the clip means 30 engaged with the other one 110C of the second two of the attachment rings 110. Again, preferably all of the rear straps 40 provide the length adjustment means 60. As previously described, the foam rubber interior layer 17 is tightly covered by fabric construction with the foam rubber being of such resilience as to take a semi-permanent curvature.

Figure 4:
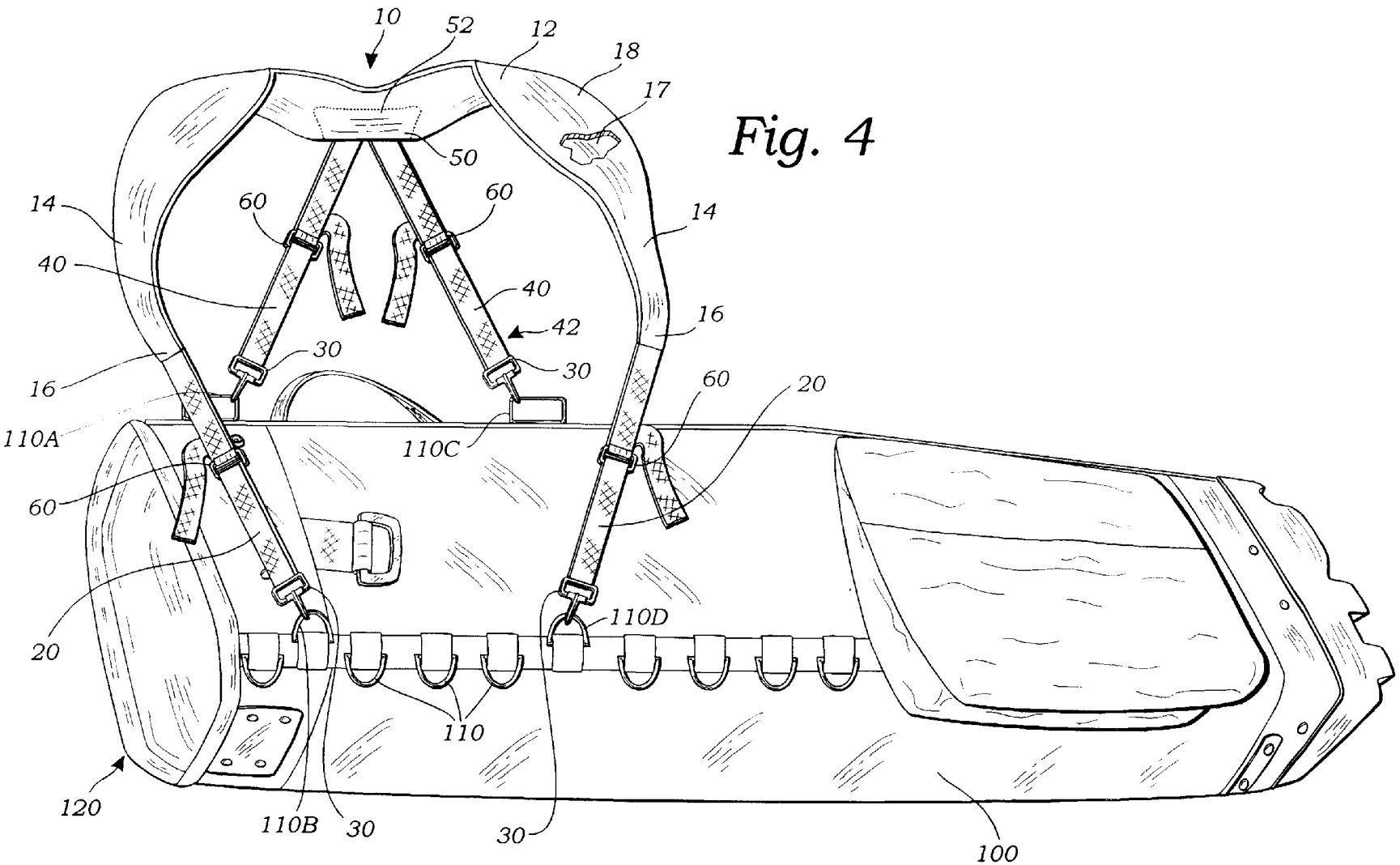
FIG. 4 is a perspective view of a rear side of the preferred embodiment of the present invention showing the two point mounting of the carrying strap of the invention.

In use, after the carrying strap 5 has been attached, as described above, to the golf bag 100, for instance as shown in FIG. 1, the arms of the person are placed into apertures "A" and "B " so that the golf bag 100 is mounted transversely behind the person for carrying it from point to point on a golf course. It should be noted that the carrying strap 5 may be attached to the golf bag 100 at two points, such as rings 110A and 110C, as shown in FIG. 1, or may be attached to the golf bag 100 at four points as shown in FIG. 4.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination golf bag and golf bag carrying strap, the combination comprising:

a golf bag providing a plurality of strap attachment rings, wherein a first two of the attachment rings are positioned in mutually spaced apart relationship adjacent to an open end of the golf bag, said open end for receiving golf clubs into the golf bag, and further wherein a second two of the attachment rings are positioned respectively in longitudinal alignment with the first two of the attachment rings in mutually spaced apart medial positions on the golf bag;

a golf bag carrying strap comprising:

a unitary and integral C-shaped yolk collar having a shoulder portion adapted for extending around the neck and over the shoulders of a person, and a pair of integral chest portions extending downwardly therefrom to cover the upper chest of the person;

a pair of front straps, each one of the pair of front straps engaged with and extending from a terminal end of each of the chest portions of the yolk collar, one of the front straps terminating with a clip engaged with one of the first two of the attachment rings, and one of the front straps terminating with a further one of said clip engaged with one of the second two of the attachment rings;

a pair of rear straps, each of the rear straps being joined at a common point at a rearmost position of the shoulder portion of the yolk collar, a free end of one of the rear straps terminating with a further one of said clip engaged with one of the first two of the attachment rings, and a free end of other of the rear straps terminating with a further one of said clip engaged with one of the second two of the attachment rings.

2. The combination of claim 1 wherein the front straps each provide a length adjustment means for adjusting the length of each strap.

3. The combination of claim 1 wherein the rear straps each provide a length adjustment means.

4. The combination of claim 1 wherein the yolk collar comprises an interior layer of at least ½ inch thick foam rubber and an outer layer of a wear resistant fabric encompassing the interior layer.

5. The combination of claim 4 wherein the foam rubber is of such resilience as to take a semi-permanent curvature through use.

* * * * *